US007121836B2

(12) United States Patent
Lai

(10) Patent No.: US 7,121,836 B2
(45) Date of Patent: Oct. 17, 2006

(54) INTEGRATED SOCKET

(75) Inventor: Chih-Ming Lai, Sindian (TW)

(73) Assignee: Giga-Byte Technology Co., Ltd., Taipei County (TW)

( * ) Notice: Subject to any disclaimer, the term of this patent is extended or adjusted under 35 U.S.C. 154(b) by 0 days.

(21) Appl. No.: 11/046,810

(22) Filed: Feb. 1, 2005

(65) Prior Publication Data

US 2006/0172560 A1 Aug. 3, 2006

(51) Int. Cl.
*H01R 12/00* (2006.01)

(52) U.S. Cl. ..... 439/59; 439/637

(58) Field of Classification Search ..... 439/218, 439/637, 327, 328

See application file for complete search history.

(56) References Cited

U.S. PATENT DOCUMENTS 4,685,031 A * 8/1987 Fife et al. ..... 361/785
6,906,929 B1 * 6/2005 Chiu ..... 361/788

* cited by examiner

*Primary Examiner*—Khiem Nguyen
(74) *Attorney, Agent, or Firm*—Rosenberg, Klein & Lee

(57) ABSTRACT

An integrated socket has a first slot and a second slot. The first slot has a structure and electric specifications in compliance with a first bus interface, and the second slot has a structure and electric specifications in compliance with a second bus interface. In addition, the first slot and the second slot are integrated into one in an efficient and a length manner, the first slot is used to support a printed circuit board with the first bus interface and the second slot is used to support a printed circuit board with the second bus interface. Because the integrated socket only occupies a length space of a computer motherboard, the space utilization of the computer motherboard is improved.

2 Claims, 3 Drawing Sheets

INTEGRATED SOCKET

FIELD OF INVENTION

The present invention relates to slots provided on a computer motherboard, and particularly to an integrated socket provided on a computer motherboard for improving the space utilization of the computer motherboard.

RELATED ART

Designers of computer motherboards have long facing a critical problem of how to accommodate more circuits in limited spaces therein.

As generally known, a plurality of different slots is typically mounted to a computer motherboard and each slot is provided for a specific printed circuit board (PCB) for its particular function. Therefore, each slot mounted to the computer motherboard occupies a length space therein. Accordingly, a lot of space is required to the computer motherboard for mounting the slot.

SUMMARY OF THE INVENTION

It is, therefore, an object of the present invention is to provide an integrated socket, which integrates two slots to support two bus interfaces respectively in an efficient manner that improves space utilization of a computer motherboard.

Particularly, the integrated socket of the present invention comprises a first slot and a second slot extending from the first slot in a length direction thereof, namely, the first slot and the second slot being integrated into one. In addition, the first slot has a structure and electric specifications in compliance with a first bus interface and the second slot has a structure and electric specifications in compliance with a second bus interface. In a preferred embodiment, the first bus interface is an AGP bus interface and the second bus interface is a PCI Express bus interface. Therefore, the integrated socket supports either a display card of the AGP bus interface through the first slot or a display card of the PCI Express bus interface through the second slot. More particularly, the integrated socket only occupies a length space of the computer motherboard when mounted to the computer motherboard so the space utilization of the computer motherboard is efficiently improved.

BRIEF DESCRIPTION OF THE DRAWINGS

The invention will become more fully understood from the detailed description given hereinbelow illustration only, and thus are not limitative of the present invention, and wherein.

DETAILED DESCRIPTION OF THE INVENTION

Figure 1:
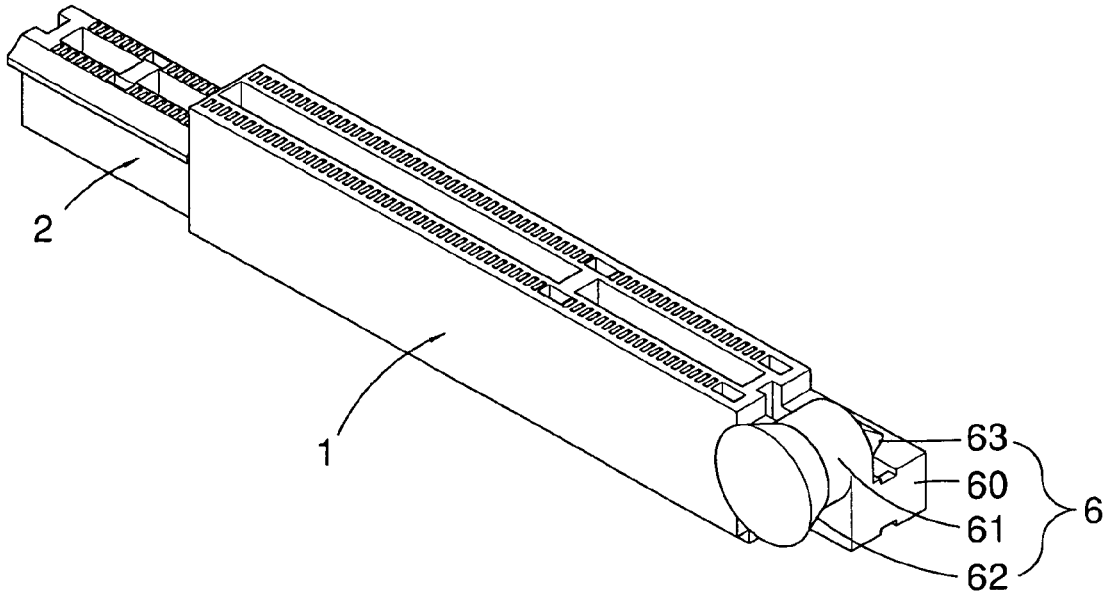
FIG. 1 is a perspective view of an integrated socket in accordance with an embodiment of the present invention.
Figure 2:
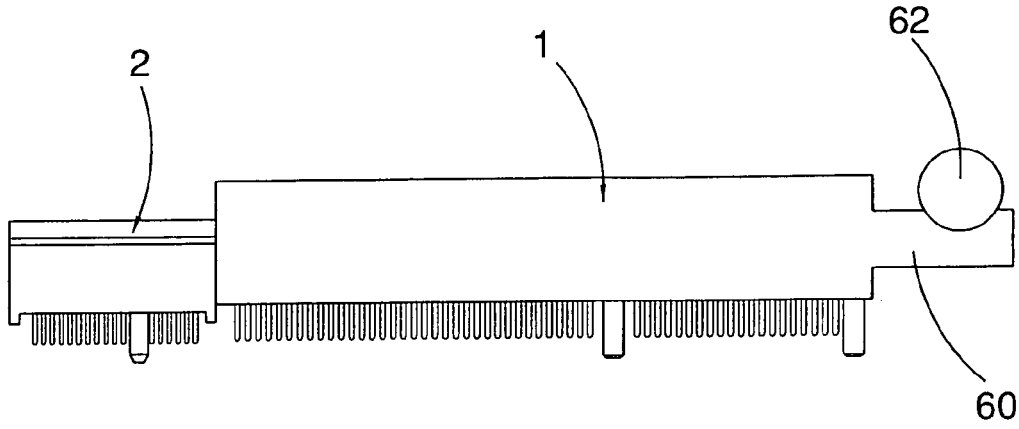
FIG. 2 is a front view of the integrated socket in accordance with the embodiment of the present invention.

Referring to FIGS. 1 and 2, an integrated socket in accordance with a preferred embodiment of the present invention is illustrated therein. The integrated socket comprises a first slot 1 having a structure and electric specifications in compliance with an AGP bus interface, and a second slot 2 having a structure and electric specifications in compliance with a PCI Express bus interface. The second slot 2 extends from the first slot 1 in a length direction thereof.

Figure 3:
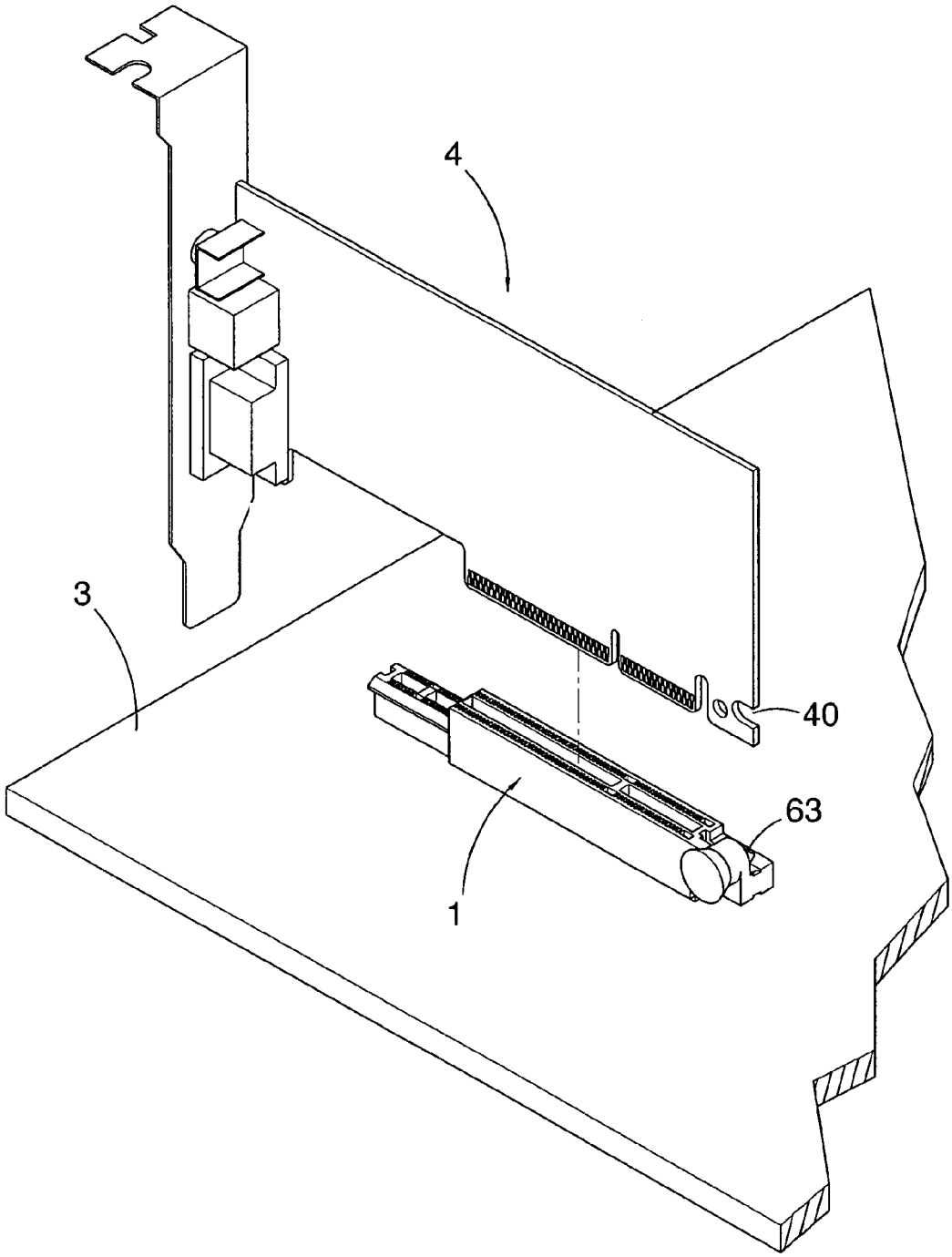
FIGS. 3 and 4 illustrate a utilization of the integrated socket in accordance with the embodiment of the present invention.

In FIG. 3, it illustrates that the integrated socket of the invention is mounted to a computer motherboard 3 and also illustrates a printed circuit board (PCB) 4 has a recess 40 at a side thereof. In this embodiment, the PCB 4 is a display card of an AGP bus interface and is applied to be inserted into the first slot 1 only.

Figure 4:
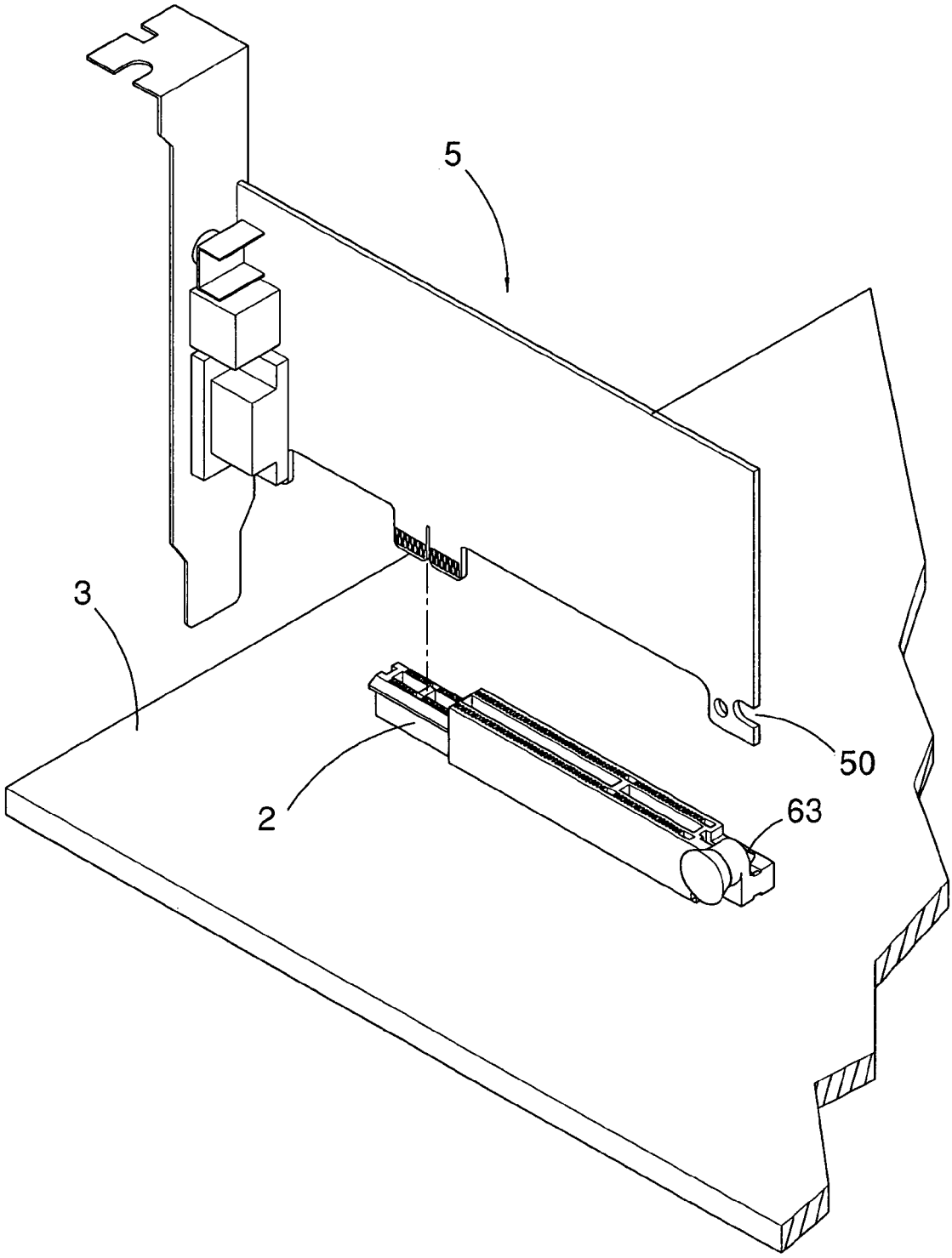

FIG. 4 illustrates that the integrated socket of the invention is mounted to the computer motherboard, and also illustrates a printed circuit board (PCB) 5 has a recess 50 at a side thereof. The PCB 5 is a display card of a PCI Express bus interface and is applied to be inserted into the second slot 2.

Please referring to FIGS. 1 and 2 again, the integrated socket further comprises a fastener part 6, which comprises a fixing seat 60 extending form the first slot 1 in a length direction which is opposite to the extending direction of the second slot 2, a holder 61 formed on the fixing seat 60 and a stud being flexibly and movably received in the holder 61 and both ends of the stud are extending out of the holder 61; in addition, one end of the stud is connected to a button 62 and the other end of the stud forms a locking part 63.

In FIGS. 3 and 4, the PCB 4 or the PCB 5 is applied to be inserted into the first slot 1 or the second slot 2, respectively. The locking part 63 is used to pass through the recess 40 or the recess 50 and to lock the PCB 4 or the PCB 5 in position.

Preferably, the first slot 1 and the second slot 2 are provided with different colors individually for the purposes of identification, such as a first color for the first slot 1 and a second color for the second slot 2. In this way, it prevents a user from error insertions when inserts a PCB to the integrated socket.

The integrated socket of the present invention not only provides an insertion of a PCB to support either two different bus interfaces but also occupies only a length space of the motherboard that efficiently improves space utilization of the computer motherboard.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims and their equivalents.

The invention claimed is:

1. An integrated socket, comprising:

a first slot having a structure and electric specifications in compliance with a first bus interface, wherein the first bus interface is an AGP bus interface;

a second slot having a structure and electric specifications in compliance with a second bus interface and extending from the first slot in a length direction thereof, wherein the second bus interface is a PCI Express bus interface; and a fastener part, comprising:

a fixing seat extending from the first slot in a length direction which is opposite to the extending direction of the second slot;

a holder formed on the fixing seat; and a stud being flexibly and movably received in the holder and both ends of the stud are extending out of the holder, wherein, one end of the stud is connected to a button and the other end of the stud forms a locking part to lock a printed circuit board in position when the printed circuit board is inserted into one of the first slot and the second slot.

2. The integrated socket as recited in claim 1, wherein the first slot has a first color and the second slot has a second color.

* * * * *